United States Patent [19]

Zumach

[11] Patent Number: 4,756,471

[45] Date of Patent: Jul. 12, 1988

[54] MAIL BOX

[76] Inventor: Fredrick Zumach, RR#2, Grand Valley, Ontario, Canada, L0N 1G0

[21] Appl. No.: 59,938

[22] Filed: Jun. 9, 1987

[30] Foreign Application Priority Data

Jun. 24, 1986 [CA] Canada ..... 512320

[51] Int. Cl.[4] ..... B65D 91/00

[52] U.S. Cl. ..... 232/17; 232/39

[58] Field of Search ..... 232/17, 39, 1 C

[56] References Cited

U.S. PATENT DOCUMENTS

| | | | |
|---|---|---|---|
| 3,672,563 | 6/1972 | McMath | 232/39 X |
| 4,244,512 | 1/1981 | Wise | 232/38 X |
| 4,367,844 | 1/1983 | Drummond | 232/38 X |
| 4,498,621 | 2/1985 | Diamond | 232/35 |

*Primary Examiner*—Robert W. Gibson, Jr.

*Attorney, Agent, or Firm*—Kramer, Brufsky & Cifelli

[57] ABSTRACT

A receptacle suitable for a mail box comprising an upright cylindrical housing having a transversely extending floor that is spaced upwardly a substantial distance from the lower end of the housing and a hemispherical top closing the upper end of the housing. A chamber to hold the mail is located between the floor and the top. A hinged door is attached to the housing and covers an opening formed in the side of the housing. Lag bolts are provided to detachably and firmly connect the housing to a post. Several holes are formed around the perimeter of the housing at the lower end thereof and well below the floor. Each hole is adapted to receive one of the lag bolts. There is also a hole formed in the center of the floor for receiving one of the bolts.

9 Claims, 1 Drawing Sheet

MAIL BOX

BACKGROUND OF THE INVENTION

This invention relates to receptacles for holding mail and similar objects.

Mail boxes have been used for a number of years, particularly in rural locations, to permit mailmen to deposit mail at an easily accessible location, for example close to the road way. A well known form of mail box comprises a sheet metal housing with flat vertical sides and a rounded top. Generally there is a hinged door located at one end of the housing that can be opened to permit the insertion of mail into the box. Often these boxes are mounted on a wooden or metal post that extends into the ground.

Some difficulties have been encountered with the commonly used mail box. One of these difficulties is that they can be easily damaged or removed from the post on which they are mounted as a result of severe weather conditions, accidents or vandalism. Because they are often located close to a roadway, it is fairly common for such a box to be bumped, accidently or otherwise, by a passing vehicle. In areas that receive a large amount of snow, it is not uncommon for mail boxes to be damaged by passing snow ploughs either as a result of direct contact by the plough or as a result of a large amount of snow being flung at the box.

Early U.S. Pat. No. 473,972 teaches a letter box that is mounted by bolts to a hollow post. The box is made of sheet metal and has flat vertical sides and a rounded top. Two ears are bent downwardly from the floor of the box and are used to connect the box to the top of the post by two bolts. One difficulty with this known arrangement is that it requires the use of a hollow post and the post must be of a predetermined size. In addition, the connection between the box and the post is not particularly strong.

U.S. Pat. No. 493,177 issued Mar. 7th, 1893 to F. H. McManigal describes an upright cylindrical letter box having a door in its side that is mounted on hinges. A downward extension of the box forms a hollow post that extends into the ground. This known mail receptacle has upper and lower compartments each with its own opening from the outside. One difficulty with this known box is that it would be reasonably expensive to construct and could be readily destroyed if accidently struck since it is made of cast metal.

Recent U.S. Pat. No. 4,498,621 issued Feb. 12, 1985 to Jeffrey S. Diamond describes a relatively complex mail box receptacle that is combined with a supporting post on which t forms an upper portion. A lateral opening is provided in the interior space above the floor and a tubular sleeve is coaxially rotatably mounted on the upper end region. This sleeve has a lateral opening which registers with the receptacle opening in one orientation of the sleeve. This known box is made from a plastics material.

It is an object of the present invention to provide a receptacle suitable for holding mail that is reasonably inexpensive to construct and that can be readily mounted to a commonly available wooden post. It is a further object of the present invention to provide a receptacle that can be mounted to a post without special tools and by unskilled personnel. The connection between the receptacle and the post can be made quite strong so that the receptacle is not likely to be inadvertently or accidently torn from its supporting post.

SUMMARY OF THE INVENTION

According to the present invention, a receptacle for holding mail and similar articles comprises an upright housing having transversely extending floor means spaced upwardly from the lower end of the housing and a top closing the upper end of the housing. A chamber for the mail is located in the housing between the floor means and the top. A door is attached to the housing and is capable of covering an opening formed in the housing. This door provides access to the aforementioned chamber. Means are provided for detachably and firmly connecting the housing to a post. The connecting means comprises a number of threaded fasteners such as lag bolts. Several holes are formed around the perimeter of the housing at the lower end thereof and below the floor means. Each of these holes is adapted to receive one of the threaded fasteners. At least one hole is formed in the floor means for receiving one of the threaded fasteners.

The connecting means includes tubular sleeves for mounting on at least some of the fasteners between the inside surface of the housing and the side of the post. These sleeves are capable of maintaining a desired distance between the vertical side of the post and the inside surface of the housing.

DETAILED DESCRIPTION OF PREFERRED EMBODIMENT

Figure 1:
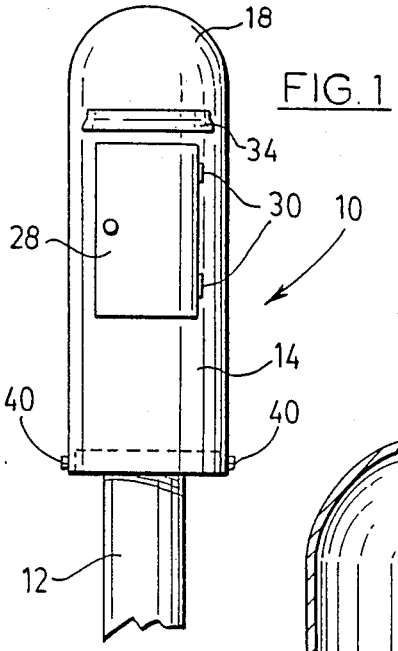
FIG. 1 is a side view of a receptacle constructed in accordance with the invention mounted on top of a wooden post.

A receptacle 10 suitable for holding mail and similar articles can be mounted on a wooden post 12. The receptacle comprises an upright cylindrical housing 14 that has an open bottom end 16 and a closed upper end 18. The upper end 18 preferably has a hemispherical shape that can be provided by a spun metal dome. The dome 18 is preferably welded to the cylindrical sidewall 20 of the housing.

Connected to the interior of the housing at a substantial distance above the lower end 16 is a transversely extending floor means 22. Preferably the floor means comprises a flat, circular steel plat. In one preferred embodiment, the dome at 18, the cylindrical sidewall 20 and the floor 22 are all made from 20 gauge steel. A mail-receiving chamber 24 is located in the housing between the floor 22 and the top at 18.

In order to permit access to the chamber 24, there is an opening 26 formed in the sidewall 20 and this opening should be large enough to permit the insertion of packages as well as ordinary mail. The opening should also be of substantial size to permit a threaded fastener to be readily screwed into the post 12 from the inside of the chamber 24 as described hereinafter. The opening 26 is covered by a door 28 that is attached by two hinges 30 to the side of the housing. Preferably the door is reinforced with suitable braces (not shown) on the inside. Preferably the hinges are standard spring-loaded hinges that will hold the door either in the fully open position or in the closed position shown in FIG. 1. The construction of such hinges is well known in the hinge art and therefore a detailed description at this time is deemed unnecessary. Holes 32 can be drilled in the sidewall 20 for the attachment of the hinges 30. Preferably the door 28 overlaps the sidewall 20 by a distanced of about one inch along all edges of the door to assist in preventing rain and snow from entering the chamber 24. If desired a suitable seal can be provided around the perimeter of the door or the door opening to prevent water from seeping in. In the illustrated embodiment, there is located above the door a rain shed or rain diverter 34 that protrudes from the sidewall of the housing. The rain shed which can be made of metal or shaped plastic helps to prevent water from entering into the mail chamber 24 through the top of the door. Alternately the dome 18 can be flared out at the bottom so as to extend out from the top of the sidewall 20 and provide a rain shed.

Figure 2:
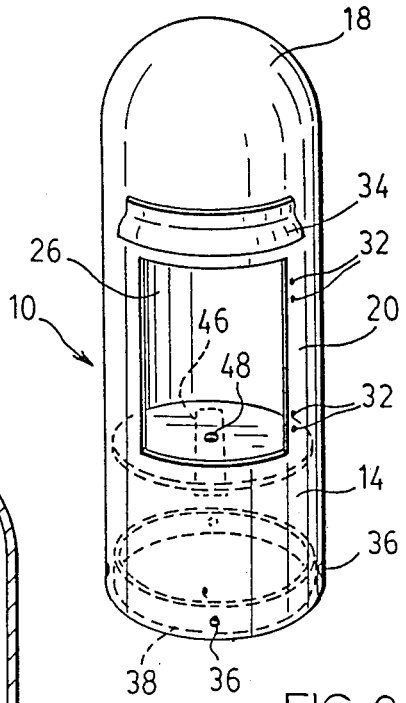
FIG. 2 is a perspective view of the receptacle of FIG. 1 with the door removed; and, FIG. 3 is a sectional elevation taken along the vertical centre line of the receptacle of FIG. 1 and showing how the receptacle is connected to the post.
Figure 3:
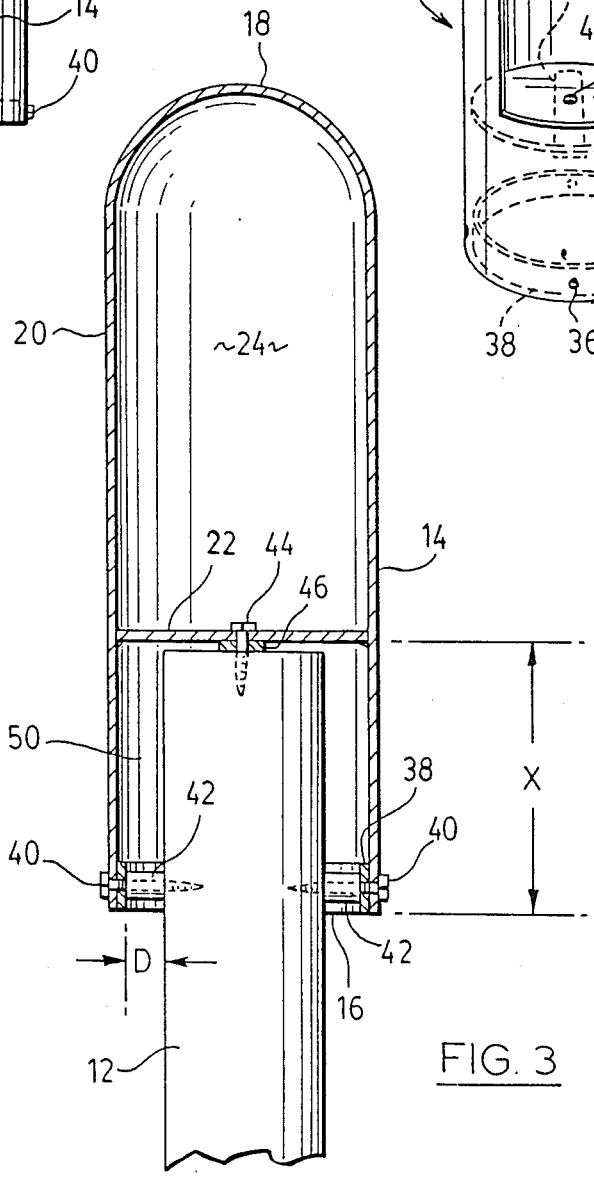

Means are provided for detachably and firmly connecting the housing 14 to the top of the post 12. The connecting means includes a number of threaded fasteners, preferably lag bolts. As shown in Figure 2, several holes 36 are formed around the perimeter of the housing at the lower end thereof. Preferably the lower end of the housing is strengthened by welding a steel ring 38 to the inside surface of the sidewall as shown. The holes 36 extend through this steel ring. Lag bolts 40 are inserted through these holes and screwed into the side of the post as shown in FIG. 3. In one preferred embodiment there are four of these bolts 40 that are evenly distributed around the perimeter of the end of the housing. Preferably these bolts are inserted through tubular metal sleeves 42 that have been cut or dimensioned so that they extend the distance D between the inside surface of the housing and the side of the post. These sleeves help to maintain the desired distance between the vertical side of the post and the inside surface of the housing. It will thus be appreciated that one size of receptacle 10 can accommodate and can be mounted on wooden posts of different sizes. It is simply necessary for the person who is erecting the mail box to cut the sleeves 42 to the proper size so that they can fit between the post and the bottom end of the housing.

The connecting means for the receptacle includes as well a lag bolt 44 that is inserted through a hole positioned in the centre of the floor means 22. The bolt 44 is screwed into the top of the wooden post 12, preferably in the centre thereof. If the opening 26 in the side of the housing is large, it is easy to gain the necessary access into the chamber 24 to fasten the bolt 44. Preferably the floor 22 is reinforced by a steel brace 46 through which the centre hole 48 extends.

In order to provide a sufficient room in the opening 26 for connecting the bolt 44 to the top of the post, the height of the opening 26 is preferably at least 10 inches and the width of the opening is at least 8 inches. In one preferred embodiment of the receptacle the opening 26 has a height of 12 inches and a width measured along the horizontal curve of the receptacle of 10 inches.

The preferred receptacle 10 has a lower post-receiving cavity 50 that is sufficiently wide to accommodate even large wooden posts and that is sufficiently deep to permit the receptacle to be securely mounted to the top end of the post. Preferably the internal diameter of the cylindrical cavity 50 is at least 9 inches and the distance X indicated in FIG. 3 is at least 8 inches. In one preferred embodiment, the diameter of the cavity 50 is about 11½ inches while the height of the cavity 50 (distance X) is 12 inches. In this particular embodiment the total height of the cylindrical sidewall 20 of the receptacle is 30 inches while the outside diameter of this sidewall is 12 inches.

It will be obvious to one skilled in the art that various modifications and changes can be made to the described and illustrated receptacle without departing from the spirit and scope of this invention. Accordingly, all such modifications and changes as fall within the scope of the appended claims are intended to form part of this invention.

I therefore claim:

1. A receptacle for holding mail and similar articles comprising an upright housing having transversely extending floor means spaced upwardly from a lower end of said housing and a top closing the upper end of said housing, a chamber for said mail being located in said housing between said floor means and said top, several holes being formed around the perimeter of said housing at the lower end thereof and below said floor means, a door attached to said housing and capable of covering an opening formed in said housing, said door providing access to said chamber, and means for detachably and firmly connecting said housing to a post, said connecting means comprising a number of threaded fasteners and tubular sleeves for mounting on at least some of said fasteners, wherein each of said holes is adapted to receive one of said threaded fasteners and at least one hole is formed in said floor means for receiving one of said threaded fasteners and where in said sleeves in use are positioned on their respective fasteners between the inside surface of said housing and the side of said post, said sleeves being capable of maintaining a desired distance between the vertical side of the post and the inside surface of said housing.

2. A receptacle according to claim 1 wherein said floor means has a circular shape and said at least one hole therein is positioned in the centre of said floor means.

3. A receptacle according to claim 1 wherein said housing has a cylindrical sidewall that extends below said floor means a substantial distance.

4. A receptacle according to claim 1 wherein said housing has a cylindrical sidewall with an internal diameter of at least 9 inches, said sidewall extending below said floor means a distance of at least 8 inches.

5. A receptacle according to claim 1 wherein said threaded fasteners comprise five lag bolts and there are four of said sleeves for mounting on four of said lag bolts.

6. A receptacle according to claim 1 wherein said door is connected by spring-loaded hinges to a sidewall of said housing and said opening covered by said door is of substantial size to permit said one threaded fastener to be readily screwed into said post from the inside of said chamber.

7. A receptacle according to claim 6 wherein said opening has a height of at least 10 inches and a width of at least 8 inches.

8. A receptacle according to claim 1 including a protruding rain diverter arranged above said door.

9. A receptacle according to claim 1 wherein said housing is made of 20 gauge steel and said top is hemispherical in shape.

* * * * *

UNITED STATES PATENT AND TRADEMARK OFFICE

CERTIFICATE OF CORRECTION

PATENT NO. : 4,756,471

DATED : July 12, 1988

INVENTOR(S) : Fredrick Zumach

It is certified that error appears in the above-identified patent and that said Letters Patent is hereby corrected as shown below:

In claim 6, line 54, change "1" to -- 2 -- .

Signed and Sealed this

Fifth Day of September, 1989

*Attest:*

*Attesting Officer*

DONALD J. QUIGG

*Commissioner of Patents and Trademarks*